United States Patent [19]

Guangorena

[11] Patent Number: 4,688,765

[45] Date of Patent: Aug. 25, 1987

[54] POSITIVE GRIP WINCH

[76] Inventor: Jesus Guangorena, 84 Nora Way, Atherton, Calif. 94025

[21] Appl. No.: 827,494

[22] Filed: Feb. 6, 1986

Related U.S. Application Data

[63] Continuation of Ser. No. 666,951, Oct. 31, 1984, abandoned.

[51] Int. Cl.[4] ..... B66D 1/30

[52] U.S. Cl. ..... 254/374; 254/371; 242/117

[58] Field of Search ..... 254/266, 371, 372, 374, 254/342, 344, 382; 242/47.01, 117

[56] References Cited

U.S. PATENT DOCUMENTS

| | | | |
|---|---|---|---|
| 23,499 | 4/1859 | Reed | 254/266 |
| Re. 30,423 | 10/1980 | Hutton et al. | 254/344 X |
| 572,457 | 12/1896 | Smith | 254/344 |
| 756,851 | 4/1904 | Hartweg | 254/266 |
| 1,554,634 | 9/1925 | Kersting | 254/344 X |
| 1,637,818 | 8/1927 | Hawkins | 254/344 |
| 2,978,224 | 4/1961 | Moseley et al. | 254/344 |
| 3,728,914 | 4/1973 | Guangorena et al. | 74/812 |
| 3,968,953 | 7/1976 | Guangorena | 254/342 |
| 3,985,340 | 10/1976 | Guangorena | 254/344 |
| 4,054,266 | 10/1977 | Guangorena | 254/345 |
| 4,120,486 | 10/1978 | Mehnert | 254/371 |
| 4,211,388 | 7/1980 | Guangorena | 254/344 |
| 4,274,606 | 6/1981 | Bernwall et al. | 242/117 |
| 4,301,979 | 11/1981 | Cavanagh | 254/371 X |

*Primary Examiner*—Stuart S. Levy
*Assistant Examiner*—Katherine Matecki
*Attorney, Agent, or Firm*—Townsend and Townsend

[57] ABSTRACT

The present invention is an improved winch drum design which improves the gripping action of the drum on a rope by departing from the traditional belt-pulley theory. The winch drum has a series of depressions at spaced intervals around the circumference of the drum. The portion of the drum between the depressions is smooth, producing a low coefficient of friction with the rope. The rope deforms as it bends over a portion of the drum between depressions at a relatively sharp angle, causing the rope to resist lengthwise movement. At the same time, the smooth surface allows the rope to easily move parallel to the spin axis of the drum, thereby facilitating the necessary climbing action of the rope from working to tailing ends. The gripping action is provided because the rope is compressed and bent between depressions, thereby making it difficult for the uncompressed portion of the rope resting over a depression to propagate lengthwise of the rope. In the preferred embodiment, the depressions do not extend to a portion of the drum adjacent a belled climbing portion of the winch.

16 Claims, 8 Drawing Figures

POSITIVE GRIP WINCH

This is a continuation of application Ser. No. 666,951, filed Oct. 31, 1984, now abandoned.

BACKGROUND OF THE INVENTION

This invention relates to a winch for pulling a flexible line and, more particularly, to a winch drum for use on a sailing vessel.

The typical winch is mounted on a base attached to the deck of a vessel or to the side of a mast, and has a drum around which a rope is wrapped. A shaft and gear assembly inside the drum can be turned by a handle to rotate the drum and wind up the line. By placing several wraps of the line around the drum, additional friction is generated which aids in the pulling of the line. One end of the line, which is typically attached to a sail, is called the "working end" and bears most of the tension in the line. As the line wraps around the winch, the amount of tension on the line is reduced to the point that a person can apply the necessary tension by pulling on the end of the line coming off of the winch, which is referred to as the "tailing end" of the line.

SUMMARY OF THE PRIOR ART

Modern Winch

Modern winches are made entirely of metal with a scored or sandblasted surface on a drum in the shape of a right cylinder in order to generate more friction. The modern winch operates on the belt-pulley theory. The rope is wrapped around the drum and tension exerted between the working end and the tailing end by pulling on the tailing end. This pulling is called "tailing." Tailing generates friction between the rope and the right cylindrical drum. Dependent upon the tension produced by tailing and the number of turns of rope around the drum, the load on the working end of the line can be increased.

The portion of the winch receiving the working end of the rope is belled larger than the right cylinder of the drum. The belled portion, typically mounted at the base of the winch, forms a "climbing portion." The climbing portion causes the rope to start climbing towards the mid-portion of the right cylindrical drum. The sharp angle of the bell prevents the rope from wrapping around the belled portion, and thus the rope will climb as it advances. This winch with its "climbing portion" is in common use today.

In a modern winch, it is desirable to have a low tailing force and thus a high coefficient of friction between the winch drum and the rope. However, it is also desirable to have the rope climb the winch (i.e., propagate from the working end to the tailing end). A high coefficient of friction will resist such climbing and the rope under tension will often move in discrete jumps along the winch as the friction is overcome. Such jumps can result in an undesirable loss of purchase on the winch or even overlapping wraps or entanglement of the line on the drum.

Overlapping wraps are unacceptable on a winch. Time required to untangle line loses races. Moreover, where an overlapping wrap is severe, the line must be cut and thereafter replaced. Unforntunately, the more turns of line about a winch drum to handle a high working load and reduce the tailing force, the more likely overlapping wraps or entanglements are to occur.

Thus, the modern winch design seeks to optimize the amount of friction to reduce the required number of turns and minimize the possibility of overlapping wraps.

Self-tailing winches have been designed to eliminate the need for applying a tailing force, thereby enabling one person to easily operate a winch. One type of self-tailing winch uses a ring having an annular groove on the top of the drum. The groove has a serrated interior for gripping the rope and pulls the rope, which is wound around the drum of the winch, paying the rope out when it encounters a guide placed over the groove. See, for example, U.S. Pat. No. 3,968,953 to Guangorena.

Older Winches

Because a smooth metal surface does not generate much friction against a rope, various methods have been used to increase the friction between the rope and the drum. Winches used in the late 1800's and early 1900's, for instance, had wooden welts added to the surface of the drum so that a rope would contact the wooden surface, resulting in more friction than with the smoother metal surface. See, for instance, U.S. Pat. No. 756,851 to Hartweg.

The wooden welts increased the friction between the rope and the drum because wood on rope (typically hemp) produced a high coefficient of friction. Wooden welts on the surface of prior art winches differed in three non-obvious respects from the invention hereinafter disclosed.

First and most importantly, the friction of the wood inhibits the climbing of the winch by the rope. Such wooden welts are not suitable for modern winches where a "climbing surface" is used to urge gathered rope to "climb" a winch.

Second, the welts of the prior art winches were the first surface which the rope would contact from the working end of the line. Consequently, breakage of the essentially non-deformable hemp lines could occur at the first welt on the working end of the line.

Thirdly, the welts of the prior art winches, even when made of metal, are small (e.g., see Coffin, U.S. Pat. No. 261,530 (1882)). These small welts are added to a drum with a circular section so that the rope contacts the drum between welts. This minimizes the bend of the rope over a welt, and prevents any substantial rope deforming action as taught hereinafter. Other winches had numerous, closely spaced welts so that the welts essentially defined a continuous cylindrical surface. (See, Hartweg, U.S. Pat. No. 756,851.)

It should be noted that hemp rope was almost exclusively used for early winches. Hemp rope is a hard, twisted rope that does not appreciably deform. As a consequence, the type of lengthwise resistance to movement taught in this invention does not exist to the same degree with hemp rope as with modern nylon rope.

Many early winches had welts added on an hourglass shape. See, e.g, U.S. Pat. No. 261,530 to Coffin. One end of the hourglass forced the working end of the rope towards the middle of the drum, while the other end of the hourglass prevented the rope from slipping off of the winch, especially when the winch was attached to the side of a mast. The hourglass shapes severly limited the number of turns that could be used. High tailing forces were required.

The hourglass shape was a disadvantage of this arrangement. The diameter of a wrap of the rope decreases as it approaches the middle of the hourglass.

This decreasing diameter caused the rope to slip and lose purchase on the winch. As the rope approaches the tailing end, the diameter of the winch increases again and the smaller diameter wrap has to expand, causing the rope to bind and even wrap.

Other winches overcame these difficulties by abandoning welts and modifying the hourglass shape to give a winch drum which is essentially a right cylinder. See, e.g., U.S. Pat. No. 3,145,974 to Short.

SUMMARY OF THE INVENTION

The present invention is an improved winch drum design which improves the gripping action of the drum on a rope by departing from the traditional belt-pulley theory used in modern winch design. The climbing portion of modern winch design is retained. At the same time, narrow strips defined between drum depressions having a low coefficient of friction with respect to the drum are created. The combination produces a winches requiring a surprisingly low tailing force. This low tailing force enables a unique self-tailing upper rim, stop, or flange to be added to the winch.

The winch drum has a series of depressions at spaced intervals around the circumference of the drum. The portion of the drum between the depressions is smooth, producing a low coefficient of friction with the rope. The rope deforms as it bends over a portion of the drum between the narrow strips and the depressions at a relatively sharp angle. This deformation at the bend causes the rope to resist lengthwise movement even though there is a low coefficient of friction between the rope and the narrow strip over which the rope is wound. At the same time, the smooth surface of the narrow strip and its low coefficient of friction allows the rope to easily move parallel to the spin axis of the drum, thereby facilitating the necessary climbing action of the rope from working to tailing ends. The gripping action is provided because the rope is compressed and bent between depressions, thereby making it difficult for the uncompressed portion of the rope resting over a depression to propagate lengthwise of the rope.

The use of a poor coefficient of friction on the drum surface is contrary to the traditional belt-pulley theory. Eliminating reliance on friction to produce a gripping force allows the rope to climb smoothly, thus preventing discrete jumps by the rope and the resultant slippage of prior art winches. This is an improvement over the early prior art winches which used welts because the entire gripping force is produced by the rope bending sharply and the frictional surface is completely eliminated. The improved gripping action of this winch dramatically reduces both the number of wraps and the required tailing force, compared to prior art winches.

In the preferred embodiment, the depressions do not extend to a portion of the drum adjacent the climbing portion of the winch. Thus, the first wrap of the rope on the winch which will be subject to the most tension does not have any sharp bends, thereby preventing the rope from breaking at a sharp bend as was possible in early winches where welts extended onto the climbing portion.

The depressions are preferably relatively wide such that the surface of the drum between the depression (sometimes referred to as a "narrow strip") is relatively narrow. At least a 3 to 1 ratio of the width of a depression to the width of a narrow strip is preferred. The recesses are preferably rectangular in shape and the drum surface under a recess is flat, so that the drum is shaped as a polygon rather than as a cylinder. Any other shape surface, or no surface, under a recess will work so long as it does not extend beyond a straight line from the terminator between one narrow strip and a depression to the terminator of an adjacent narrow strip. The preferred number of depressions is approximately 8 on an average size winch. These characteristics improve the gripping action of the rope by causing relatively sharp bends in the rope with accompanying rope deformation. The depressions of the present invention prevent all contact of the drum by the rope. The surface of the winch which receives the working end of the rope is flush with the surface between depressions. Thus, a wrap need not expand to climb the winch, as it would if welts were used, since welts increase the diameter of the winch drum.

The winch is also self-tailing in the preferred embodiment. A flange around the circumference of the drum at the tailing end of the drum acts as a stop for the uppermost wrap of the rope. The flange has a flat bottom surface which extends sharply at a small angle from the surface of the drum. The uppermost wrap of the rope is wedged between the bottom surface of this flange and the next wrap. The wraps are kept in side-by-side compression by the upward force of the lowermost wrap being forced to climb the winch by the belled portion of the winch. The winch is able to self-tail due to the combination of (1) the sharp angle of this flange, which departs from the gradual curves of prior art winches, (2) the large gripping force possible with the depressions of the present invention, and (3) the smooth surface which allows the rope to easily climb and thereby wedge the upper wrap. It is the unique combination of these three factors which makes self-tailing possible in this simple winch design and eliminates the requirement of adding additional rings or other equipment as in the prior art.

DETAILED DESCRIPTION OF THE PREFERRED EMBODIMENT

Figure 1A:
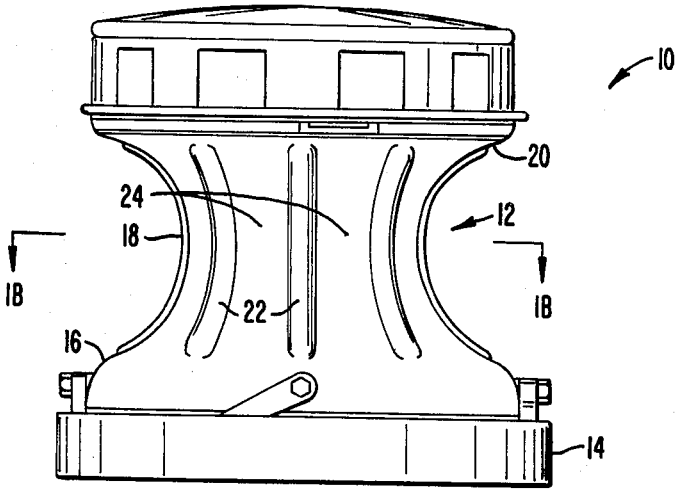
FIG. 1A. PRIOR ART
FIG. 1A is a side elevation view of a prior art winch with welts.

The operation of the present invention is best understood by comparing it with prior art winches. FIG. 1A shows a prior art winch 10 of the type in use in the early 1900's. A winch drum 12 is mounted on a base 14. Drum 12 is adapted to receive the working end of the rope at a climbing portion 16, which would force the rope upward to a working portion 18, with the rope being paid off at its tailing end at an upper portion 20. The drum surface has a number of welts 22, a can be seen by referring to FIG. 1B, which shows a plan section of FIG. 1A. Welts 22 are added on to a cylindrical surface 24 of drum 12. Welts 22 are typically made of metal. As can be seen from FIG. 1B, rope 26 contacts both surface 24 and welts 22 with a slight bending around welts 22.

Figure 1B:
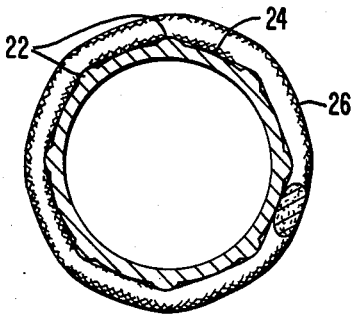
FIG. 1B. PRIOR ART
FIG. 1B is a plan section view of the prior art winch of FIG. 1A.
Figure 1C:
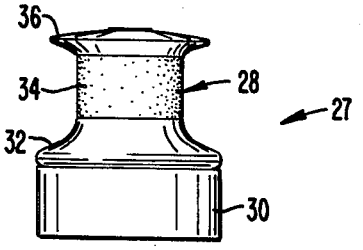
FIG. 1C. PRIOR ART
FIG. 1C is a side elevation view of a modern prior art winch having a sandblasted cylindrical drum surface.

A more modern winch 27 is shown in FIG. 1C. A drum 28 is mounted on a base 30. Drum 28 has a climbing portion, 32, a sandblasted working portion 34, and a flange 36. Sandblasted portion 34 provides the friction which grips the rope. Climbing portion 32 forces the working end of the rope upward onto working portion 34. Flange 36 prevents the rope from slipping off winch 27, especially when mounted sideways on the side of a mast for hoisting and lowering a halyard.

Figure 2:
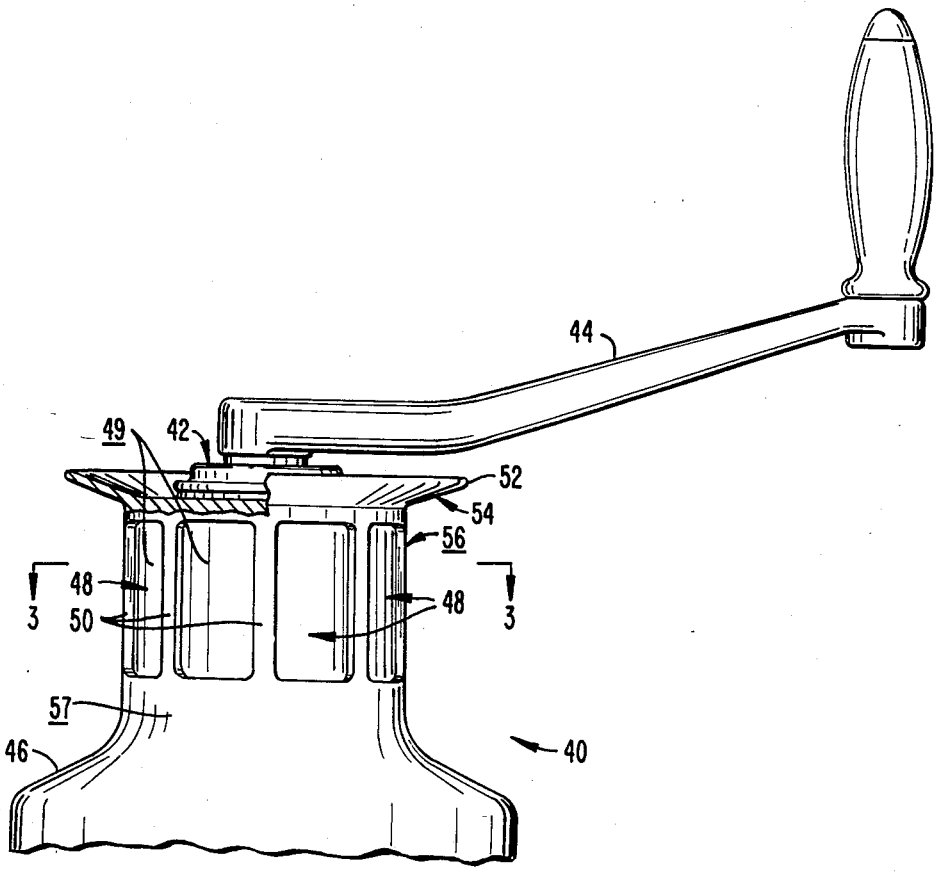
FIG. 2 is a side elevation view of the preferred embodiment of the present invention.

FIG. 2 shows a preferred embodiment of the present invention. A winch drum 40 is mounted on a base (not shown) and houses a shft 42 coupled to an internal gear assembly (not shown), which is turned by a handle 44. Drum 40 has a smooth, belled climbing surface 46 and a working surface 56 with a series of depressions 48. Depressions 48 define a series of narrow strips 50 which run along drum 40 parallel to the spin axis of the drum. Drum 40 has an upper flange 52 with a flat surface 54 extending at a sharp angle from line working surface 56 of the drum. Line working surface 56 has an interrupted portion consisting of the exterior surfaces of narrow strips 50 and a smooth portion 57. Surface 56 forms a cylinder around the spin axis of drum 40.

Figure 3:
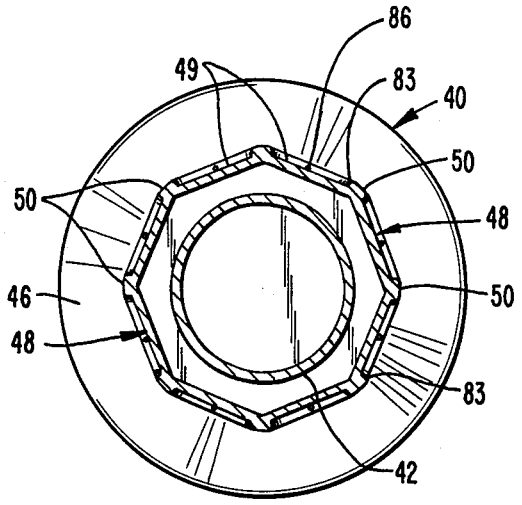
FIG. 3 is a plan section of the preferred embodiment of the present invention.

FIG. 3 shows a plan section of the preferred embodiment of the present invention of FIG. 2. FIG. 3 shows that portions 49 of drum 40 in depressions 48 are flat surfaces, resulting in winch drum 40 having a polygon shape, rather than a cylindrical shape.

Figure 4:
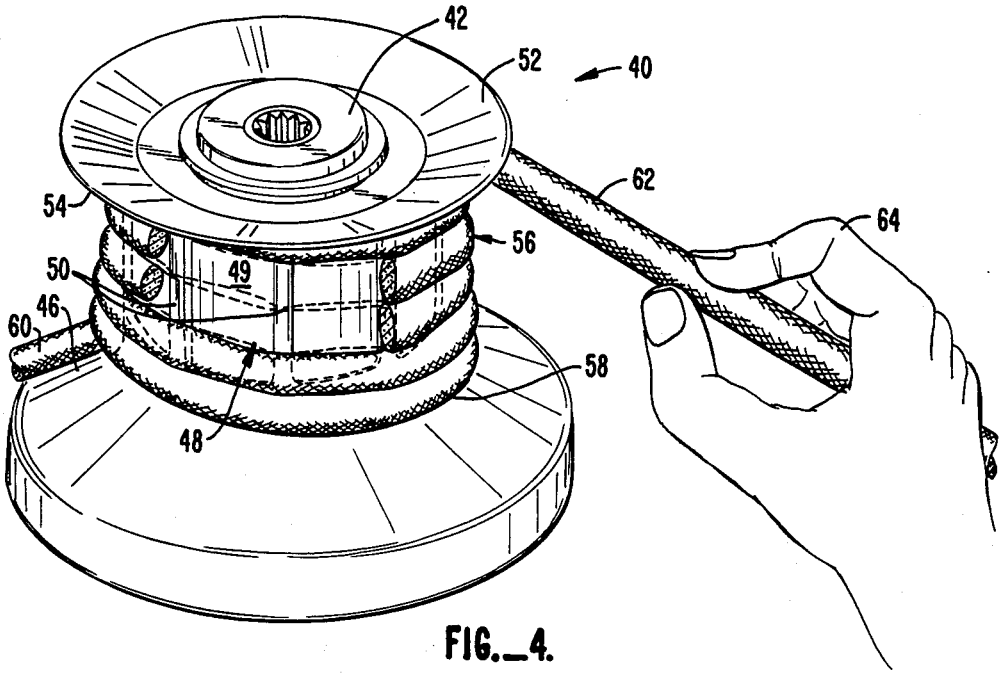
FIG. 4 is a perspective view of the present invention showing the tailing action of a rope.

FIG. 4 shows a perspective view of the preferred embodiment of the winch of FIGS. 2 and 3 in operation with a rope 58. A working end 60 of rope 58 would typically be attached to a sail (not shown), and winds around winch 40 beginning on surface 46. Rope 58 winds around winch 40 with several wraps and comes off of the winch at the tailing end 62. A person's hand 64 is shown pulling the tailing end 62 with only two fingers.

Figure 5A:
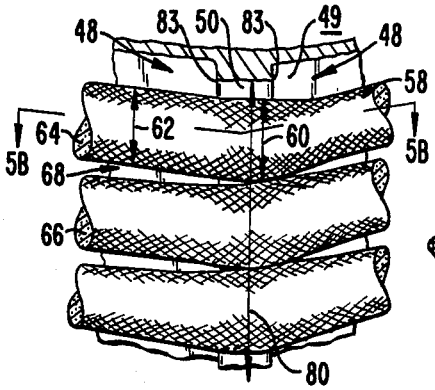
FIG. 5A is a perspective, cut-away view of a rope passing over the drum of the preferred embodiment of the present invention with the deformation of the rope greater exaggerated.
Figure 5B:
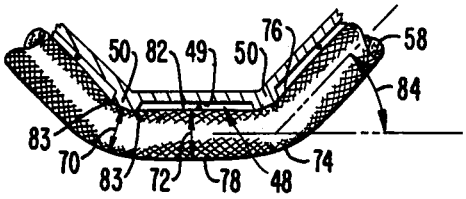
FIG. 5B is a plan section of FIG. 5A with the deformation of the rope greatly exaggerated.

The operation of the winch can be seen with the aid of the added detail of FIGS. 5A and 5B. FIG. 5A is a blown-up view of rope 58 passing over a narrow strip 50 and depression 48, with the deformation of the rope greatly exaggerated. FIG. 5B is a plan section along lines 5B—5B of FIG. 5A. As can be seen from FIG. 5A, as rope 58 passes over narrow strip 50 in circumferential tension, the rope is compressed against narrow strip 50 and thereby flattened and widened to a diameter 60. The portion of rope 58 over depression 48 has a lesser diameter 62. This difference in diameter results in adjacent wraps 64 and 66 of rope 58 creating a gap 68, which is greatly exaggerated in FIG. 5A.

Rope 58 passing over narrow strip 50 is also radially flattened to a diameter 70, as shown in FIG. 5B. The radial diameter 70 is less than a radial diameter 72 of the rope over a depression 48. The outer portion 74 of rope 58 passing over a narrow strip 50 is more tightly stretched than an inner portion 76 of rope 58 over narrow strip 50. This greater stretching produces the flattening effect and compresses the rope. A portion 78 of the rope over a depression 48 must become so compressed and stretched in order to move lengthwise over a narrow strip 50. This results in the gripping action of the present invention, which relies upon this non-propagation of the deformation of rope 58 to grip winch 40.

At the same time, the surface of narrow strip 50 is smooth, allowing axial movement of the rope along the narrow strip, as shown by arrows 80 of FIG. 5A. The axial movement allowable by arrows 80 is directed upward by belled surface 46 of the winch.

The present invention goes against the traditional belt-pulley theory of using friction for a gripping force. Friction is virtually eliminated as a gripping force, allowing rope 58 to move up narrow strip 50 without impairment. The jumping action of a rope overcoming friction as its climbs, as found in prior art winches, is eliminated.

The improvement of the present invention over the prior art winches with welts is easily seen by comparing FIGS. 5B and 1B. Because rope 26 of FIG. 1B contacts surface 24 between welts 22, the rope does not bend as sharply around welts 22 and there is not the same degree of deformation as in the present invention. Rope 58 in FIG. 5B does not touch surface 49 in depression 48, resulting in a gap 82. The flatness of surface 49, rather than the rounded shape with added welts 22 in FIG. 1B, enables gap 82 to exist. Any other shape of surface, or no surface, could be used in place of surface 49 as long as the surface does not contact rope 58 between narrow strips 50.

Depressions 48 are at least three times as wide as narrow strips 50, thereby resulting in a relatively sharp angle 84 of rope 58 passing over narrow strip 50. In the preferred embodiment, eight narrow strips 50 are used, resulting in a bending angle 84 of 45°. More narrow strips could be used, but a bending angle 84 of at least 30° is preferred. The gripping action of the present invention is better than gripping provided by friction in prior art inventions and can result in a difference in required tailing force of from 50 pounds for a typical prior art winch to approximately one or two pounds for the present invention. This is demonstrated graphically by the ability of a hand 64 to pull the tailing section with only two fingers, as shown in FIG. 4. This greater gripping action allows less wraps to be used, thereby lessening the danger of the wraps of rope 58 overlapping one another and then binding.

Rope 58 takes approximately one and one-half wraps on belled surface 46 and working surface 56 before depression 48 and narrow strips 50 are reached. Thus, working end 60 of rope 58 does not encounter a sharp bend over a narrow strip 50 until the tension has been dissipated by one and one-half wraps on a smooth surface. This is an improvement over the prior art winch of FIG. 1A, wherein a rope would immediately encounter a welt and thus break at a lower tension than the present invention.

A plane normal to the spin axis of winch 40 must cut a shape of line working surface 56 which is generally circular to prevent uneven forces on the winch as it is turned. The wraps of rope 58 easily climb working portion 56 of drum 40 due the low coefficient of friction between the rope and the surface of narrow strips 50. Working portion 56 is preferably parallel to the spin axis of drum 40 thereby forming a right cylinder with narrow strips 50, although tapering of up to approximately 5° would be possible without greatly impairing the action of the winch. Less than a 5° taper is considered a right cylinder for purposes of this description. However, greater tapering, as in prior art hourglass winches, such as winch 10 of FIG. 1A, impairs the rope's ability to climb beyond narrow midsection 18 of the winch. The diameter of a wrap must expand to climb beyond midsection 18, and binding results. This is an undesirable result which is prevented by the structure of the present invention.

The self-tailing function of the present winch can be seen by referring to FIG. 4. Working end 60 of rope 58 forces the wraps of the rope upwards against lower flat surface 54 of flange 52. This causes tailing end 62 of rope 58 to be wedged against surface 54. This wedging is possible because of (1) the sharp angle of surface 54 relative to working surface 56, (2) the low coefficient of friction on narrow strips 50 which allows the wraps of rope 58 to easily climb winch 40, and (3) the gripping action of narrow strips 50 which prevents slippage of rope 58 which would undo such wedging action. Prior art winches had rounded flanges, such as flange 36 of FIG. 1C, to prevent the rope from unwrapping from the winch, particularly when mounted sideways on a mast. The flatness of surface 54 and its sharp angle to working portion 56 improves the prior art flange so that it can serve a self-tailing function when combined with depressions 48 of the present invention and the low coefficient of friction on narrow strips 50. Thus, the need to add a self-tailing ring, which is expensive and complicated, is eliminated.

The reader will understand that the self-tailing feature could be realized by other designs. For example, rounded fingers, rubber caps or other artifacts producing side-by-side compression of adjacent wraps of rope 58 could be used.

The winch of the present invention is preferably made completely of stainless steel and given a smooth surface. The operation of the winch of the present invention shows even greater improvement over prior art winches when the winch and the line are both wet. Such wetness decreases the friction between the rope and winch, thereby decreasing the efficiency of prior art winches while increasing the efficiency of the presnet winch, which is designed to take advantage of a low coefficient of friction. Additionally, the compression of rope 58 over narrow strips 50 in effect wrings out the rope with the water being able to run through depressions 48, which act as drains. A hole 86 appears at the bottom of each depression 48 to allow water to drain out of the depression typically into the interior of drum 40. The reader will understand that other drains could work as well. For example, a small external channel which does not appreciably interrupt the preferred smooth surface of the winch could work as well. Although prior art winches, such as that shown in FIG. 1C, may perform such wringing, there is no route for the water to escape from between the rope and the winch.

Upon releasing rope 58 from winch 40 in the present invention, several wraps must be undone in addition to simply easing up on tailing section 62 due to the improved gripping action of the winch. Rope 58 is thereafter released in the normal manner by paying-out tailing end 62.

The present invention works best with a braided line which is easily subjectable to deformation. A twisted line will also work, although less effectively, and a wire cable will be much less effective because it will deform permanently and develop kinks. It can also be seen that the larger the diameter of rope 58, the greater the deformation on the outer surface of the rope around narrow strip 50. This can be understood by comparing the ease of bending of a small diameter pipe as opposed to a large diameter pipe. The large diameter pipe will not bend around as sharp an angle because the outer surface must stretch a greater amount than the outer surface of a smaller pipe. The same applies to a rope being used in the present invention, thereby requiring a larger diameter winch and larger number of small angles for such a larger diameter rope.

Depressions 48 of the present invention could be circular, elliptical, or S-shaped, so long as the deformation action shown in FIGS. 5A and 5B occurs. As will be understood by those familiar with the art, the present invention may be embodied in other specific forms without departing from the spirit or essential characteristics thereof. Accordingly, the disclosure of the preferred embodiments of the invention herein is intended to be illustrative, but not limiting, of the scope of the invention which is set forth in the following claims.

What is claimed is:

1. A winch drum for use with a rotary winch, said rotary winch functioning to tune said winch drum about an axis and work a line wound with a plurality of turns over and around said drum between a working end of the line attached to a load and a tailing end of the line, said drum comprising:

a line working surface disposed on the exterior of a cylindrical plane coaxial with the axis of said winch;

said line working surface having a smooth portion and an interrupted portion of low friction coefficient relative to said line wound with a plurality of turns over and around said drum between the working end of the line attached to said load and the tailing end of the line;

said smooth portion positioned to receive the working end of said line and including a smooth climbing portion and a smooth cylindrical portion, said smooth portions positioned to receive at least one wrap of the line to reduce the line tension before engagement with said interrupted portion;

said interrupted portion positioned to receive said line between said smooth portion and the tailing end of said line;

said interrupted portion defining a plurality of depressions at spaced intervals around a right cylindrical plane about said winch axis, said interrupted portion further defining interstitial narrow strips between said depressions, said narrow strips having terminators at either side thereof adjoining said depressions to dispose said line substantially as a chord between said terminators; and said narrow strips having a low coefficient of friction relative to line wound over said narrow strips to enable movement of said line parallel to the axis of said winch and providing a sufficient bend to line passing over said narrow strips so that deformation of said line at the ends of said chord around said terminators between said narrow strips and said depressions cause resistance to the movement of said line relative to the length of said line when wound about said interrupted portion under tension.

2. The drum of claim 1 wherein the line as disposed over the working surface of the drum spans the interval between the narrow strips without contacting the drum.

3. The drum of claim 1 wherein there are between 4 and 12 narrow strips.

4. The drum of claim 1 further comprising means, coupled to each of said depressions, for draining water out of said depression.

5. The drum of claim 4 wherein said draining means comprises said drum defining a drain at an edge of each said depression.

6. The drum of claim 1 further comprising a second smooth portion positioned to receive said line at the tailing end of said line.

7. A rotary winch functioning to turn a winch drum about an axis and work a line wound with a plurality of turns over and around said drum between a working end of the line attached to a load and a tailing end of the line, said winch comprising:

a line working surface disposed on the exterior of a cylindrical plane coaxial with the axis of said winch;

said line working surface having a smooth portion and an interrupted portion relative to said line wound with a plurality of turns over and around said drum between a working end of the line attached to a load and the tailing end of the line said line working surface;

said smooth portion positioned to receive the working end of said line and including a smooth climbing portion and a smooth cylindrical portion, said smooth portions positioned to receive at least one wrap of the line to reduce the line tension before engagement with said interrupted portion;

said smooth climbing portion comprising a belled portion to enable climbing of said line over said interrupted portion of said line working surface;

said interrupted portion positioned to receive said line between said smooth portion and the tailing end of said line;

said interrupted portion defining a plurality of depressions at spaced intervals around a right cylindrical plane about said winch axis, said interrupted portion further defining interstitial narrow strips between said depressions, said narrow strips having terminators at either side thereof adjoining said depressions to dispose said line substantially as a chord between said terminators; and said narrow strips having a low coefficient of friction relative to line wound over said narrow strips to enable movement of said line parallel to the axis of said winch and providing a sufficient bend to line passing over said narrow strips so that deformation of said line at the ends of said chord and around said terminators between said narrow strips and said depressions cause resistance to the movement of said line relative to the length of said line when wound about said interrupted portion under tension.

8. The winch of claim 7 wherein the line as disposed over the working surface of the drum spans the interval between the narrow strips without contacting the drum.

9. The winch of claim 7 wherein there are between 4 and 12 narrow strips.

10. The winch of claim 7 further comprising a second smooth portion positioned to receive said line at the tailing end of said line.

11. A rotary winch functioning to turn a winch drum about an axis and work a line wound with a plurality of turns over and around said drum between a working end of the line attached to a load and a tailing end of the line, said drum comprising:

a line working surface disposed on the exterior of a cylindrical plane coaxial with the axis of said winch;

said line working surface having a smooth portion and an interrupted portion relative to said line wound with a plurality of turns over and around said drum between a working end of the line attached to said load the tailing end of the line;

said smooth portion positioned to receive the working end of said line and including a smooth climbing portion and a smooth cylindrical portion, said smooth portions positioned to receive at least one wrap of the line to reduce the line tension before engagement with said interrupted portion;

said smooth cylindrical portion being disposed on a right cylndrical plane about said winch axis;

said interrupted portion positioned to receive said line between said smooth portion and the tailing end of said line;

said interrupted portion defining a plurality of depressions at spaced intervals around said right cylindrical plane about said winch axis, said interrupted portion further defining interstitial narrow strips between said depressions, said narrow strips having terminators at either side thereof adjoining said depressions;

said narrow strips having a low coefficient of friction with respect to line wound over said narrow strips to enable movement of said line parallel to the axis of said winch and providing a sufficient bnet to line passing over said narrow strips so that deformation of said line at the terminators between said narrow strips and said depressions cause resistance to the movement of said line relative to the length of said line when wound about said interrupted portion under tension; and flange means without moving parts disposed proximate the upper end of said drum opposite said climbing portion having a surface with said low coefficient of friction to permit said line remote from said climbing portion to remain on said drum and thereafter self tail from said drum whereby said smooth portion and said interrupted portion wedge said line to said flange means surface having said low coefficient of friction to enable said line to self tail from said drum, for retaining said line on said drum.

12. A self-tailing winch drum for use with a rotary winch, said rotary winch functioning to turn said winch drum about an axis and work a line wound with a plurality of turns over and around said drum between a working end of the line attached to a load and a tailing end of the line, said drum comprising:

a line working surface disposed on the exterior of a cylindrical plane coaxial with the axis of the winch;

said line working surface having a smooth portion and an interrupted portion relative to said line wound with a plurality of turns over and around said drum between the working end of the line attached to said load and the tailing end of the line;

said smooth portion positioned to receive the working end of said line and including a smooth climbing portion and a smooth cylindrical portion, said smooth portions positioned to receive at least one wrap of said line to reduce the line tension before engagement with said interrupted portion;

said smooth climbing portion comprising a belled portion to enable climbing of said line over said interrupted portion of said line working surface;

said interrupted portion positioned to receive said line between said smooth portion and the tailing end of said line;

said interrupted portion defining a plurality of depressions at spaced intervals around a right cylindrical plane about said winch axis, said interrupted portion further defining interstitial narrow strips between said depressions, said narrow strips having terminators at either side thereof adjoining said depressions;

said narrow strips having a low coefficient of friction relative to line wound over said narrow strips to enable movement of said line parallel to the axis of said winch and providing a sufficient bend to line passing over said narrow strips so that deformation of said line at the terminators between said narrow strips and said depressions cause resistance to the movement of said line relative to the length of said line when wound about said interrupted portion under tension; and means for restraining movement of said line in a direction away from said smooth portion, attached to said drum proximate said interrupted portion at an end remote from said smooth portion;

such that said tailing end of said line will be wedged against said restraining means whereby a self-tailing function is provided.

13. The drum of claim 12 wherein said restraining means comprisies a flange at an angle of no more than 50 degrees to a line normal to the spin axis of said drum.

14. The drum of claim 12 and wherein said smooth cylindrical portion of the working surface is a right cylinder.

15. The drum of claim 12 wherein the line as disposed over the working surface of the drum spans the interval between the narrow strips without contacting the drum.

16. The drum of claim 12 wherein there are between 4 and 12 narrow strips.

* * * * *